US008473302B2

(12) United States Patent
Lee et al.

(10) Patent No.: US 8,473,302 B2
(45) Date of Patent: Jun. 25, 2013

(54) PARAMETRIC AUDIO ENCODING AND DECODING APPARATUS AND METHOD THEREOF HAVING SELECTIVE PHASE ENCODING FOR BIRTH SINE WAVE

(75) Inventors: Geon-hyoung Lee, Hwaseong-si (KR); Jong-hoon Jeong, Suwon-si (KR); Nam-suk Lee, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 1104 days.

(21) Appl. No.: 12/170,819

(22) Filed: Jul. 10, 2008

(65) Prior Publication Data

US 2009/0063162 A1 Mar. 5, 2009

(30) Foreign Application Priority Data

Sep. 5, 2007 (KR) ..... 10-2007-0089971

(51) Int. Cl.
*G10L 21/04* (2006.01)

(52) U.S. Cl.
USPC ..... 704/504; 704/200.1; 704/200; 704/500; 704/503; 704/E19.005

(58) Field of Classification Search
USPC ..... 704/500, 501, 503, E19.022, E19.03
See application file for complete search history.

(56) References Cited

U.S. PATENT DOCUMENTS

| | | | | |
|---|---|---|---|---|
| 4,885,790 | A * | 12/1989 | McAulay et al. | 704/265 |
| 4,937,873 | A * | 6/1990 | McAulay et al. | 704/265 |
| 5,886,276 | A | 3/1999 | Levine et al. | |
| 6,266,644 | B1 | 7/2001 | Levine | |
| 7,020,615 | B2 | 3/2006 | Vafin et al. | |
| 7,058,571 | B2 | 6/2006 | Tsushima et al. | |
| 7,146,324 | B2 * | 12/2006 | Den Brinker et al. | 704/500 |
| 7,197,454 | B2 * | 3/2007 | Van Der Kerkhof et al. | 704/219 |
| 7,542,896 | B2 * | 6/2009 | Schuijers et al. | 704/201 |
| 2003/0040918 | A1 * | 2/2003 | Burrows | 704/500 |
| 2003/0083886 | A1 * | 5/2003 | Den Brinker et al. | 704/500 |
| 2005/0091041 | A1 * | 4/2005 | Ramo et al. | 704/205 |
| 2005/0177360 | A1 * | 8/2005 | Schuijers et al. | 704/201 |
| 2005/0259822 | A1 * | 11/2005 | Sluijter et al. | 380/236 |

(Continued)

FOREIGN PATENT DOCUMENTS

| | | | |
|---|---|---|---|
| JP | 2003-337598 | A | 11/2003 |
| WO | WO 2004006225 | A1 * | 1/2004 |

OTHER PUBLICATIONS

Schuijers et al. "Advances in Parametric Coding for High-Quality Audio" 2003.*

(Continued)

*Primary Examiner* — Greg Borsetti
(74) *Attorney, Agent, or Firm* — Sughrue Mion, PLLC

(57) ABSTRACT

Provided are parametric audio encoding and decoding apparatuses and methods thereof. In the parametric audio encoding method, an audio signal is segmented into a plurality of segments. At least one sine wave is extracted from each of the segments, and the extracted sine waves are connected. It is determined whether an extracted sine wave is a birth sine wave. If the extracted sine wave is a birth sine wave, a bit stream is generated by encoding the phase of the birth sine wave on the basis of the frequency of the birth sine wave, wherein the number of bits allocated to encode the phase of the birth sine wave is adjusted according to the frequency of the birth sine wave.

18 Claims, 8 Drawing Sheets

U.S. PATENT DOCUMENTS

| | | | | |
|---|---|---|---|---|
| 2006/0009967 | A1* | 1/2006 | Gerrits et al. | 704/200 |
| 2006/0147048 | A1* | 7/2006 | Breebaart et al. | 381/23 |
| 2007/0027678 | A1* | 2/2007 | Hotho et al. | 704/203 |
| 2007/0112560 | A1* | 5/2007 | Gerrits et al. | 704/205 |
| 2007/0127729 | A1* | 6/2007 | Breebaart et al. | 381/18 |

OTHER PUBLICATIONS

McAulay et al. "Speech Analysis/Synthesis Based on a Sinusoidal Representation" 1986.*
Edler et al. "Parametric Audio Coding" 2000.*
Geiger et al. "ISO/IEC MPEG-4 High-Definition Scalable Advanced Audio Coding" Feb. 2007.*
Breebaart et al. "High-quality parametric spatial audio coding at low bitrates" 2004.*
Hotho et al. "A Narrowband Low Bit Rate Sinusoidal Audio and Speech Coder" 2004.*
van de Par et al. "A PerceptualModel for Sinusoidal Audio Coding Based on Spectral Integration" 2005.*
Purnhagen et al. "Sinusoidal Coding Using Loudness-Based Component Selection" 2002.*
Purnhagen et al. "Parameter Estimation and Tracking for Time-Varying Sinusoids" 2002.*
den Brinker et al. "Phase transmission in a sinusoidal audio and speech coder" 2003.*
Jang et al. "Multiresolution Sinusoidal Model with Dynamic Segmentation for Timescale Modification of Polyphonic Audio Signals." IEEE Transactions on Speech and Audio Processing, vol. 13, Issue 2, Mar. 2005, pp. 254-262.
Painter et al. "Perceptual Segmentation and Component Selection for Sinusoidal Representations of Audio." IEEE Transactions on Speech and Audio Processing, vol. 13, Issue 2, Mar. 2005, pp. 149-162.

* cited by examiner

PARAMETRIC AUDIO ENCODING AND DECODING APPARATUS AND METHOD THEREOF HAVING SELECTIVE PHASE ENCODING FOR BIRTH SINE WAVE

CROSS-REFERENCE TO RELATED PATENT APPLICATION

This application claims priority from Korean Patent Application No. 10-2007-0089971, filed on Sep. 5, 2007 in the Korean Intellectual Property Office, the disclosure of which is incorporated herein in its entirety by reference.

BACKGROUND OF THE INVENTION

1. Field of the Invention

Apparatuses and methods consistent with the present invention relate to parametric audio encoding and decoding, and more particularly, to parametric audio encoding and decoding, which connectively encode sine waves of an audio signal.

2. Description of the Related Art

A parametric audio scheme separately encodes a sine wave and noise of an audio signal. The phase, frequency and amplitude of a sine wave need to be decoded in order to describe the sine wave. In order to increase a bit rate, sine waves, which are continuous in terms of time and have similar frequencies, are connected with each other and encoded successively.

Hereinafter, a first-generated sine wave is referred to as a "birth sine wave" and a sine wave connected with the birth sine wave is referred to as a "connected sine wave". In general, the phase, frequency and amplitude of a birth sine wave are all decoded. On the other hand, only the phase and amplitude (or the frequency and amplitude) of a connected sine wave are decoded. The reason for this is that the frequency/phase of a current sine wave can be derived from the phase/frequency of a previous sine wave.

All of the amplitude, frequency and phase of a birth sine wave need to be encoded in order to describe the birth sine wave. Therefore, a larger number of bits are needed in order to compress an audio signal without degrading sound quality.

SUMMARY OF THE INVENTION

The present invention provides parametric audio encoding and decoding apparatuses and methods thereof, which connectively encode sine waves of an audio signal in such a way to increase a compression rate while maintaining the sound quality of the audio signal.

According to an aspect of the present invention, there is provided a parametric audio encoding method comprising: segmenting an input audio signal into a plurality of segments; extracting at least one sine wave from each of the segments; connecting the extracted sine waves; determining whether each of the extracted sine waves is a birth sine wave; and if an extracted sine wave is a birth sine wave, generating a bit stream by encoding the phase of the birth sine wave on the basis of the frequency of the birth sine wave, wherein the number of bits allocated to encode the phase of the birth sine wave is adjusted according to the frequency of the birth sine wave.

The encoding of the phase of the birth sine wave may allocate no bits to the phase of the birth sine wave if the frequency of the birth sine wave is higher than a predetermined threshold frequency.

The encoding of the phase of the birth sine wave may comprise: determining a quantization step as the product of the frequency of the birth sine wave and a predetermined constant; quantizing the phase of the birth sine wave according to the quantization step; and generating a bit stream by encoding the quantized phase of the birth sine wave.

The encoding of the phase of the birth sine wave may comprise: converting the frequency of the sine wave into a psychoacoustic frequency; determining a quantization step as the product of the psychoacoustic frequency and a predetermined constant; quantizing the phase of the birth sine wave according to the quantization step; and generating a bit stream by encoding the quantized phase of the birth sine wave.

The frequency of the sine wave may be converted into the psychoacoustic frequency by one of an equivalent rectangular band (ERB) function, a bark band scale function, and a critical band function.

The bit stream may comprise: connection information indicating whether the sine wave is the birth sine wave; an encoded amplitude of the birth sine wave; and an encoded frequency of the birth sine wave.

The bit stream may further comprise quantization step information.

According to another aspect of the present invention, there is provided a parametric audio encoding apparatus comprising: a segmenter segmenting an input audio signal into a plurality of segments; a sine wave extractor extracting at least one sine wave from each of the segments; a sine wave connector connecting the extracted sine waves; a birth sine wave determiner determining whether each of the extracted sine waves is a birth sine wave; and an encoder generating, if an extracted sine wave is a birth sine wave, a bit stream by encoding the phase of the birth sine wave on the basis of the frequency of the birth sine wave, wherein the encoder adjusts the number of bits, which is allocated to encode the phase of the birth sine wave, according to the frequency of the birth sine wave.

According to another aspect of the present invention, there is provided a parametric audio decoding method comprising: parsing an input bit stream; determining whether an encoded sine wave is an encoded birth sine wave; if the encoded sine wave is the encoded birth sine wave, decoding the encoded amplitude and frequency of the birth sine wave; decoding the encoded phase of the birth sine wave on the basis of the frequency of the birth sine wave; and restoring the birth sine wave using the amplitude, frequency and phase of the birth sine wave, and restoring an audio signal using the restored birth sine wave.

The decoding of the encoded phase of the birth sine wave may determine the phase of the birth sine wave to be a random value between 0 and $2\pi$ radians, if the frequency of the birth sine wave is higher than a predetermined threshold frequency.

The decoding of the encoded phase of the birth sine wave may decode the encoded phase of the birth sine wave using quantization step information included in the input bit stream.

The decoding of the encoded phase of the birth sine wave may include: determining a quantization step using the frequency of the birth sine wave; and decoding the encoded phase of the birth sine wave using the quantization step.

According to another aspect of the present invention, there is provided a parametric audio decoding apparatus comprising: a parser parsing an input bit stream; a birth sine wave determiner determining whether an encoded sine wave from the parser is an encoded birth sine wave; a first decoder decoding the encoded amplitude and frequency of the birth sine wave if the encoded sine wave is the encoded birth sine wave; a second decoder decoding the encoded phase of the birth sine wave on the basis of the frequency of the birth sine wave; and a restorer restoring the birth sine wave using the amplitude, frequency and phase of the birth sine wave, and restoring an audio signal using the restored birth sine wave.

According to another aspect of the present invention, there is provided a computer-readable recording medium storing a program for performing a parametric audio encoding method comprising: segmenting an input audio signal into a plurality of segments; extracting at least one sine wave from each of the segments; connecting the extracted sine waves; determining whether each of the extracted sine waves is a birth sine wave; and if an extracted sine wave is a birth sine wave, generating a bit stream by encoding the phase of the birth sine wave on the basis of the frequency of the birth sine wave, wherein the number of bits allocated to encode the phase of the birth sine wave is adjusted according to the frequency of the birth sine wave.

According to aspect embodiment of the present invention, there is provided a computer-readable recording medium storing a program for performing a parametric audio decoding method comprising: parsing an input bit stream; determining whether an encoded sine wave is an encoded birth sine wave; if the encoded sine wave is the encoded birth sine wave, decoding the encoded amplitude and frequency of the birth sine wave; decoding the encoded phase of the birth sine wave on the basis of the frequency of the birth sine wave; and restoring the birth sine wave using the amplitude, frequency and phase of the birth sine wave, and restoring an audio signal using the restored birth sine wave.

BRIEF DESCRIPTION OF THE DRAWINGS

The above and other aspects of the present invention will become more apparent by describing in detail exemplary embodiments thereof with reference to the attached drawings in which.

DETAILED DESCRIPTION OF EXEMPLARY EMBODIMENTS OF THE INVENTION

The present invention will now be described more fully with reference to the accompanying drawings, in which exemplary embodiments of the invention are shown.

Figure 1:
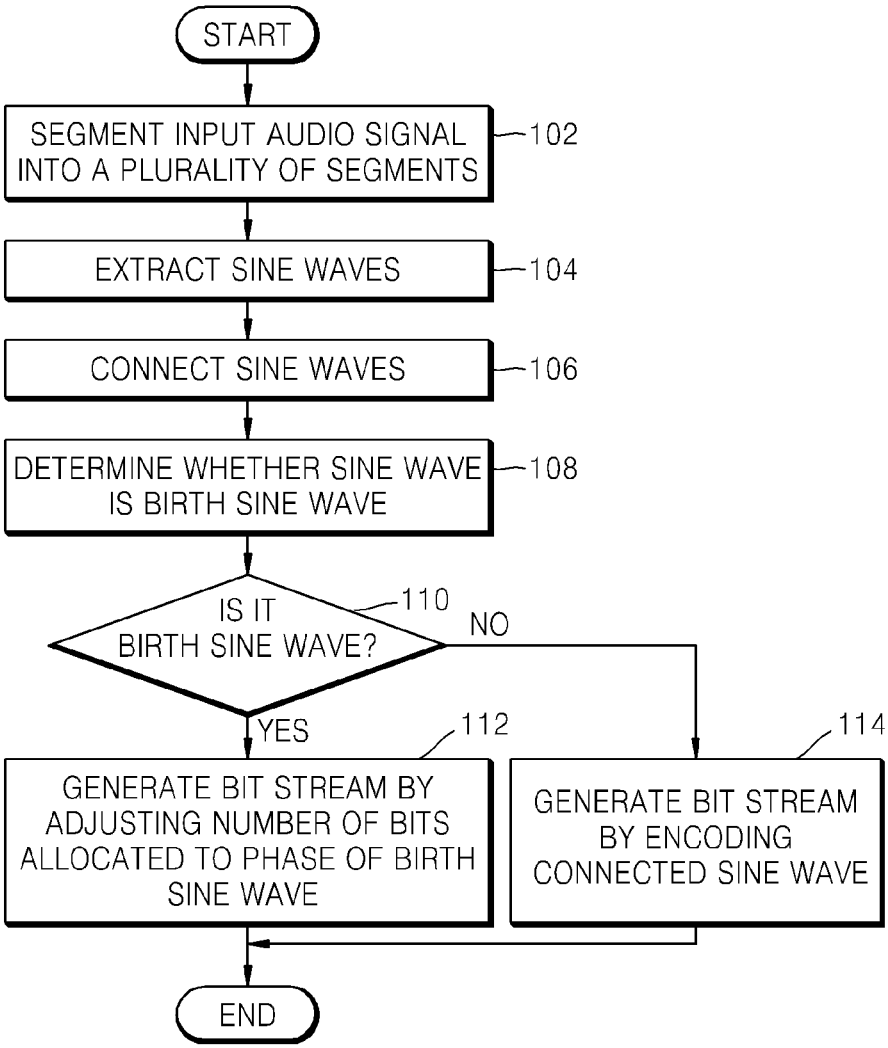
FIG. 1 is a flowchart of a parametric audio encoding method according to an exemplary embodiment of the present invention.

FIG. 1 is a flowchart of a parametric audio encoding method according to an exemplary embodiment of the present invention.

Referring to FIG. 1, an input audio signal is segmented into a plurality of segments in operation 102. For example, the input audio signal may be segmented into a plurality of segments each having a time length L, where L is an integer. If the input audio signal is segmented into a plurality of segments each having a time length L, each of the segments may overlap the previous segment by L/2 or a predetermined time length.

In operation 104, at least one sine wave is extracted from each of the segments. A sine wave with the largest amplitude is extracted from the segmented audio signal, and then a sine wave with the next-largest amplitude is extracted. The extracting of a sine wave may be repeated until the amplitude of a sine wave reaches a predetermined amplitude.

In operation 106, the extracted sine waves are connected. That is, based on the frequency of a sine wave extracted from the previous audio signal segment, a sine wave extracted from the current audio signal segment is connected with the sine wave extracted from the previous audio signal segment. If the frequency of the sine wave extracted from the current audio signal segment is similar to the frequency of the sine wave extracted from the previous audio signal segment, the sine wave extracted from the current audio signal segment is connected with the sine wave extracted from the previous audio signal segment. If the frequencies of the extracted sine waves are similar throughout several segments, the sine waves with the similar frequencies are encoded in a connective manner.

In operation 108, it is determined whether each of the extracted sine waves is a birth sine wave, i.e., a sine wave that is not connected with the sine wave extracted from the previous segment. Whether the extracted sine wave is a birth sine wave or a connected sine wave can be determined on the basis of the results of connecting the extracted sine waves.

If it is determined that the extracted sine wave is a birth sine wave in operation 110, the phase of the birth sine wave is encoded based on the frequency of the birth sine wave to generate a bit stream in operation 112. A number of bits allocated to encode the phase of the birth sine wave is adjusted according to the frequency of the birth sine wave. The reason for this is that as the frequency of an audio signal (i.e., a sine wave) increases, it becomes more difficult for humans to recognize the phase of the audio signal (i.e., the sine wave). Therefore, if the frequency of the birth sine wave is high, it is possible to reduce the number of bits allocated to encode the phase of the birth sine wave. Exemplary embodiments of this will be described below with reference to FIGS. 2 through 4.

The bit stream includes information about the encoded amplitude and frequency of the birth sine wave. Also, the bit stream may include connection information indicating whether the sine wave is a birth sine wave. On the basis of the connection information included in the bit stream, a parametric audio decoding apparatus, which will be described later, can determine whether the sine wave is a birth sine wave. Also, the bit stream may include quantization step information about the phase of the sine wave.

If it is determined that the extracted sine wave is a birth sine wave in operation 110, a connected sine wave is encoded to generate a bit stream in operation 114. The phase and amplitude (or the frequency and amplitude) of the connected sine wave are encoded and included in the bit stream.

Figure 2:
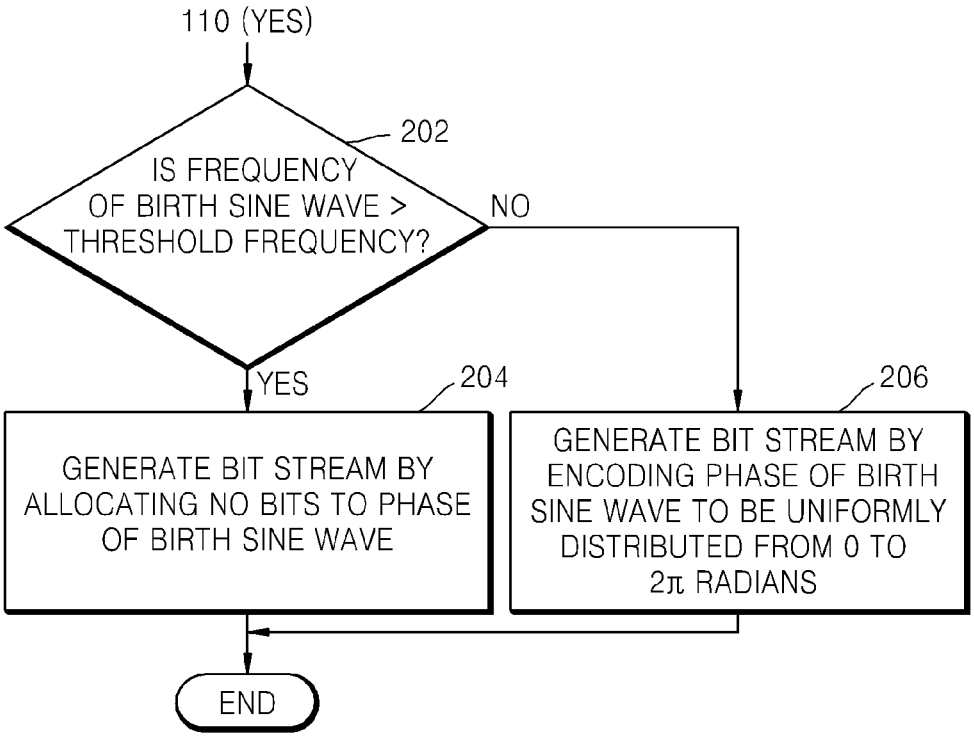
FIG. 2 is a flowchart of a parametric audio encoding method according to another exemplary embodiment of the present invention.

FIG. 2 is a flowchart of a parametric audio encoding method according to another exemplary embodiment of the present invention. FIG. 2 illustrates an exemplary embodiment of encoding the phase of the birth sine wave as in operation 112 of FIG. 1.

Referring to FIG. 2, it is determined whether the frequency of the birth sine wave is higher than a predetermined threshold frequency, in operation 202.

If is determined that the frequency of the birth sine wave is higher than the predetermined threshold frequency in operation 202, the number of bits allocated to encode the phase of the birth sine wave is 0, i.e., the phase of the birth sine wave is not transmitted, in operation 204. The reason for this is that if the frequency of a sine wave is higher than about 3 KHz, the phase of the sine wave is difficult for humans to recognize. Thus, the predetermined threshold frequency may be set to about 3 KHz.

If is determined that the frequency of the birth sine wave is not higher than the predetermined threshold frequency in operation 202, the phase of the birth sine wave is encoded to be uniformly distributed from 0 to $2\pi$ radians in operation 206.

Figure 3:
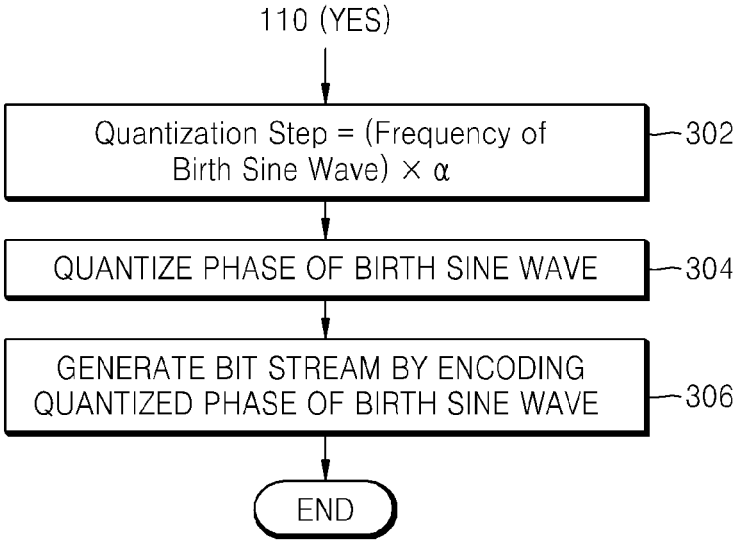
FIG. 3 is a flowchart of a parametric audio encoding method according to another exemplary embodiment of the present invention.

FIG. 3 is a flowchart of a parametric audio encoding method according to another exemplary embodiment of the present invention. FIG. 3 illustrates another exemplary embodiment of encoding the phase of the birth sine wave as in operation 112 of FIG. 1.

Referring to FIG. 3, a quantization step, for quantizing the phase of the birth sine wave, is determined, in operation 302, by the following equation.

$$\text{Quantization Step}=(\text{Frequency of Birth sine wave})\times(\text{Constant }\alpha)$$

According to the above equation, the quantization step increases as the frequency of the birth sine wave increases. If the quantization step increases, the number of bits for encoding the phase of the birth sine wave decreases. Thus, the number of bits for encoding the phase of the birth sine wave can be adjusted by changing the constant $\alpha$.

Therefore, a small number of bits are allocated in a low-frequency domain where the recognition by humans is difficult, while a relative large number of bits are allocated in a low-frequency domain where the recognition by humans is easy.

Information about the quantization step determined in operation 302 may be included in a generated bit stream.

In operation 304, the phase of the birth sine wave is quantized according to the determined quantization step based on the following equation.

$$Q=\text{round}(\text{modular}(\text{phi}, 2\pi)/\text{step})$$

where round denotes round-off, phi denotes the phase of the birth sine wave, step denotes the quantization step, and (modular(phi, $2\pi$) denotes the remainder of the phase of the birth sine wave divided by $2\pi$.

In operation 306, a bit stream is generated by encoding the quantized phase of the birth sine wave. Thus, as the frequency of the birth sine wave increases, a smaller number of bits can be allocated to the phase of the birth sine wave.

Figure 4:
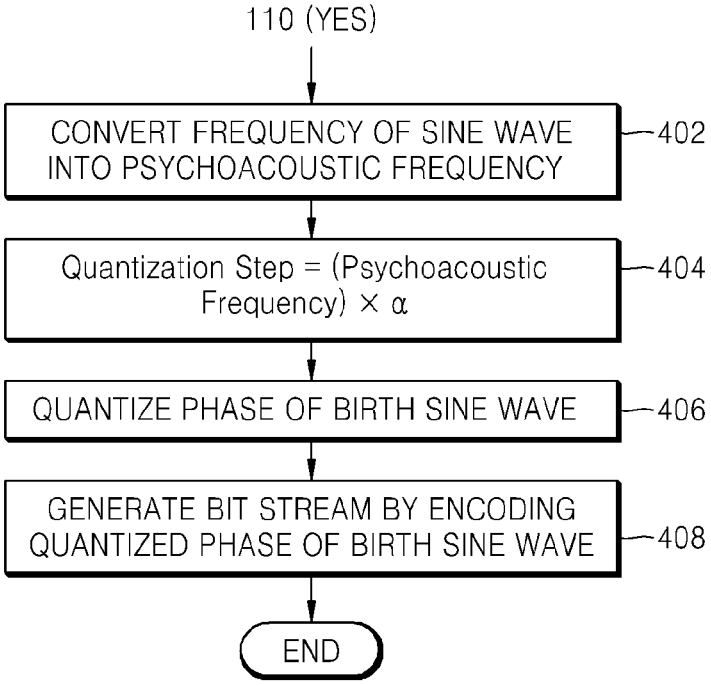
FIG. 4 is a flowchart of a parametric audio encoding method according to another exemplary embodiment of the present invention.

FIG. 4 is a flowchart of a parametric audio encoding method according to another exemplary embodiment of the present invention. FIG. 4 illustrates another exemplary embodiment of encoding the phase of the birth sine wave as in operation 112 of FIG. 1.

Referring to FIG. 4, the frequency of the birth sine wave is converted into a psychoacoustic frequency, in operation 402. If an audio signal has a high frequency, humans are unable to recognize both the frequency and the phase of the audio signal. Thus, the relationship between the sine wave frequency and the psychoacoustic frequency is defined such that a low frequency is accurately encoded, while a high frequency is inaccurately encoded. Therefore, as the frequency of the birth sine wave increases, a change in the psychoacoustic frequency becomes small.

The frequency of the birth sine wave may be converted into a psychoacoustic frequency using an equivalent rectangular band (ERB) function, a bark band scale function, or a critical band function. For example, using the ERB function, the frequency of the birth sine wave can be converted into a psychoacoustic frequency based on the following equation.

$$\text{ERB}(f)=24.7(4.37(f/1000)+1)$$

where f denotes the frequency of the birth sine wave.

A quantization step for quantizing the phase of the birth sine wave is determined, in operation 404, by the following equation.

$$\text{Quantization Step}=(\text{Psychoacoustic Frequency})\times(\text{Constant }\alpha)$$

That is, the above constant $\alpha$ may be changed to adjust the number of bits for encoding the phase of the birth sine wave.

Also, a generated bit stream may include information about the quantization step determined based on the above equation.

In operation 406, the phase of the birth sine wave is quantized according to the determined quantization step.

In operation 408, a bit stream is generated by encoding the quantized phase of the birth sine wave. Operations 406 and 408 of FIG. 4 are similar to operations 304 and 306 of FIG. 3, and thus their detailed description will be omitted for conciseness.

Figure 5:
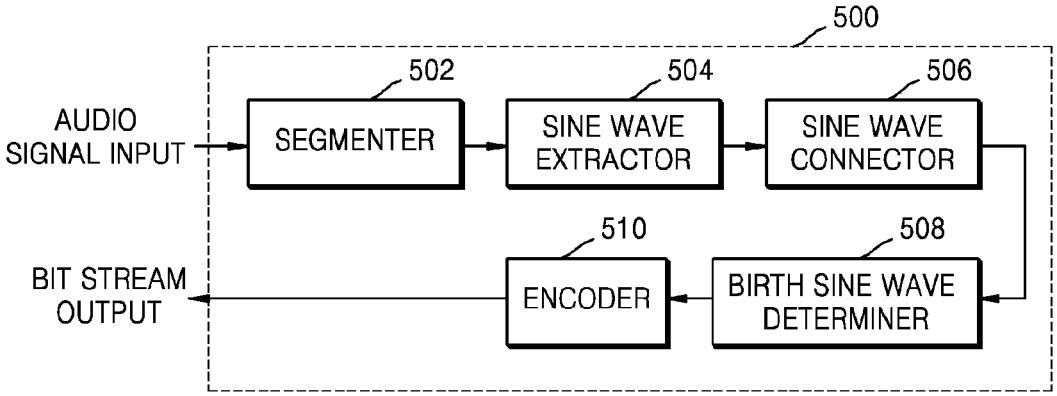
FIG. 5 is a block diagram of a parametric audio encoding apparatus according to an exemplary embodiment of the present invention.

FIG. 5 is a block diagram of a parametric audio encoding apparatus according to an exemplary embodiment of the present invention.

Referring to FIG. 5, a parametric audio encoding apparatus 500 includes a segmenter 502, a sine wave extractor 504, a sine wave connector 506, a birth sine wave determiner 508, and an encoder 510.

The segmenter 502 segments an input audio signal into a plurality of segments. For example, if the input audio signal is segmented into a plurality of segments each having a time length L, where L is an integer, each of the segments may overlap the previous segment by L/2 or a predetermined time length.

The sine wave extractor 504 extracts at least one sine wave from each of the segments. The sine wave extractor 504 may repeat the sine wave extracting operation until the amplitude of the sine wave reaches a predetermined amplitude.

The sine wave connector 506 connects the extracted sine waves. That is, if the frequency of a sine wave extracted from the current segment is similar to the frequency of a sine wave extracted from the previous segment, the sine wave connector 506 connects the sine wave extracted from the current segment with the sine wave extracted from the previous segment.

The birth sine wave determiner 508 determines whether each of the extracted sine wave is a birth sine wave.

If the birth sine wave determiner 508 determines that an extracted sine wave is a birth sine wave, the encoder 510 generates a bit stream by encoding the phase of the birth sine wave on the basis of the frequency of the birth sine wave. Based on the frequency of the birth sine wave, the encoder 510 adjusts the number of bits allocated to encode the phase of the birth sine wave. For example, if the frequency of the birth sine wave is higher than a predetermined threshold frequency, the encoder 510 may allocate no bits to the phase of the birth sine wave.

The bit stream generated by the encoder 510 includes information about the encoded amplitude of the birth sine wave and the encoded frequency of the birth sine wave. Also, the bit stream may include connection information indicating whether the sine wave is a birth sine wave. Additionally, the bit stream may include quantization step information about the phase of the sine wave.

Also, the encoder 510 generates a bit stream by encoding the phase and amplitude (or the frequency and amplitude) of a connected sine wave.

Figure 6:
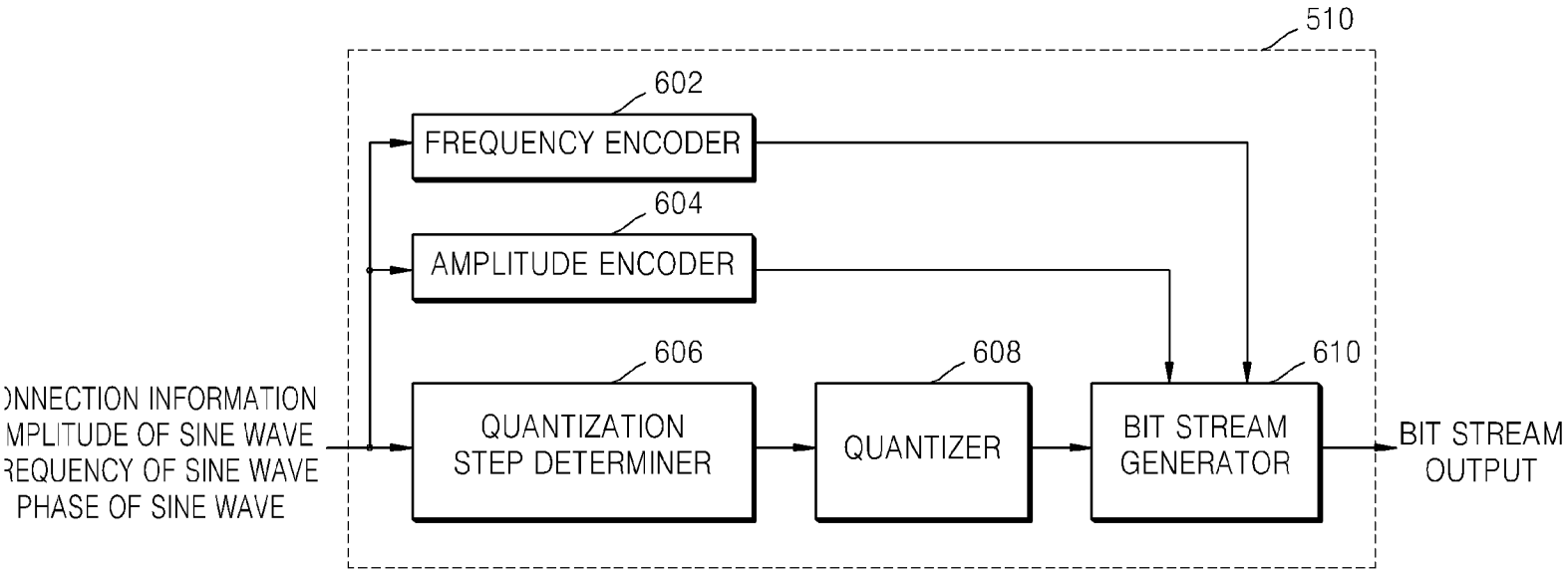
FIG. 6 is a block diagram of a parametric audio encoding apparatus according to another exemplary embodiment of the present invention.

FIG. 6 is a block diagram of a parametric audio encoding apparatus according to another exemplary embodiment of the present invention.

Referring to FIG. 6, an encoder 510 includes a frequency encoder 602, an amplitude encoder 604, a quantization step determiner 606, a quantizer 608, and a bit stream generator 610.

The frequency encoder 602 receives the frequency of the birth sine wave from the birth sine wave determiner 508, and generates a signal by encoding the received frequency of the birth sine wave.

The amplitude encoder 604 receives the amplitude of the birth sine wave from the birth sine wave determiner 508, and generates a signal by encoding the received amplitude of the birth sine wave.

The quantization step determiner 606 receives the connection information, the phase of the birth sine wave, and the frequency of the birth sine wave from the birth sine wave determiner 508, and determines a quantization step to be the product of the frequency of the birth sine wave and a predetermined constant.

The quantizer 608 quantizes the phase of the birth sine wave according to the quantization step determined by the quantization step determiner 606.

The bit stream generator 610 generates a bit stream by encoding the quantized phase of the birth sine wave.

Figure 7:
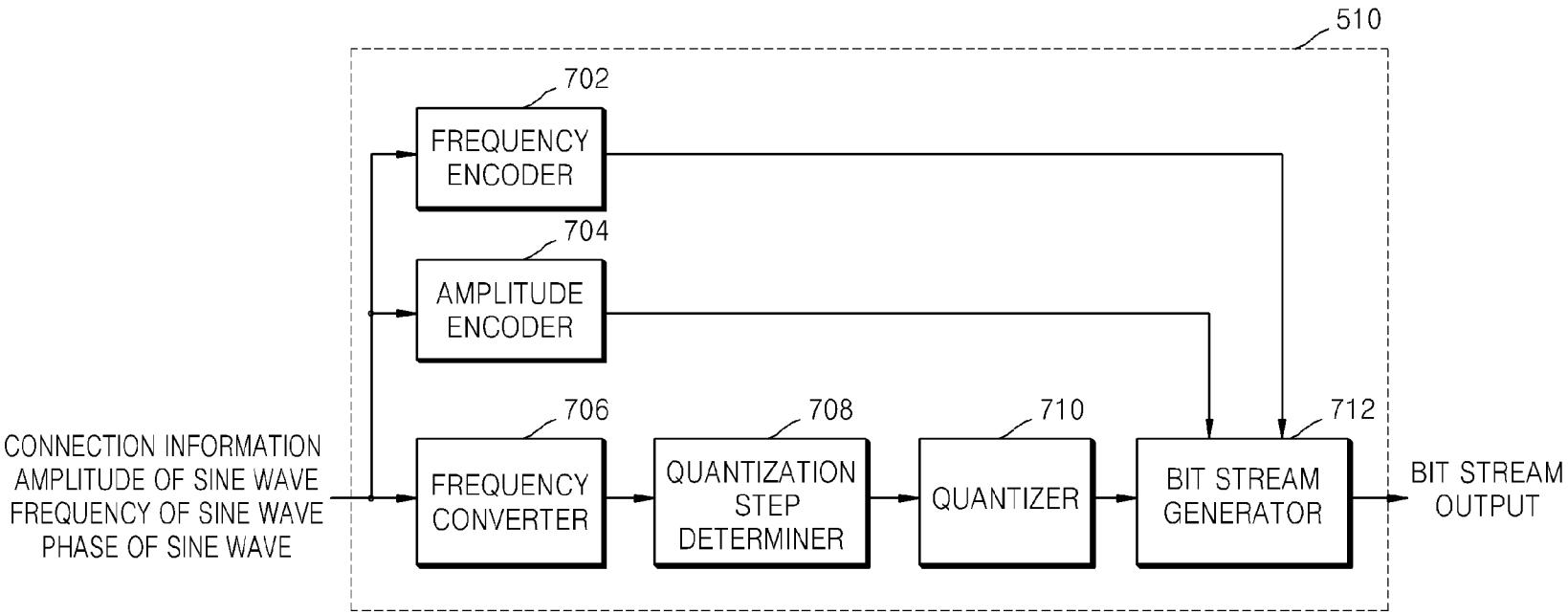
FIG. 7 is a block diagram of a parametric audio encoding apparatus according to another exemplary embodiment of the present invention.

FIG. 7 is a block diagram of a parametric audio encoding apparatus according to another exemplary embodiment of the present invention. FIG. 7 illustrates an exemplary embodiment that converts the frequency of the birth sine wave into a psychoacoustic frequency and determines a quantization step on the basis of the psychoacoustic frequency.

Referring to FIG. 7, an encoder 510 includes a frequency encoder 702, an amplitude encoder 704, a frequency converter 706, a quantization step determiner 708, a quantizer 710, and a bit stream generator 712.

The frequency converter 706 converts the frequency of the birth sine wave into a psychoacoustic frequency. Also, instead of the frequency of the birth sine wave, the psychoacoustic frequency is input into the quantization step determiner 708.

The frequency encoder 702, the amplitude encoder 704, the quantization step determiner 708, the quantizer 710, and the bit stream generator 712 of FIG. 7 respectively operate in the same way as the frequency encoder 602, the amplitude encoder 604, the quantization step determiner 606, the quantizer 608, and the bit stream generator 610 of FIG. 6.

Figure 8:
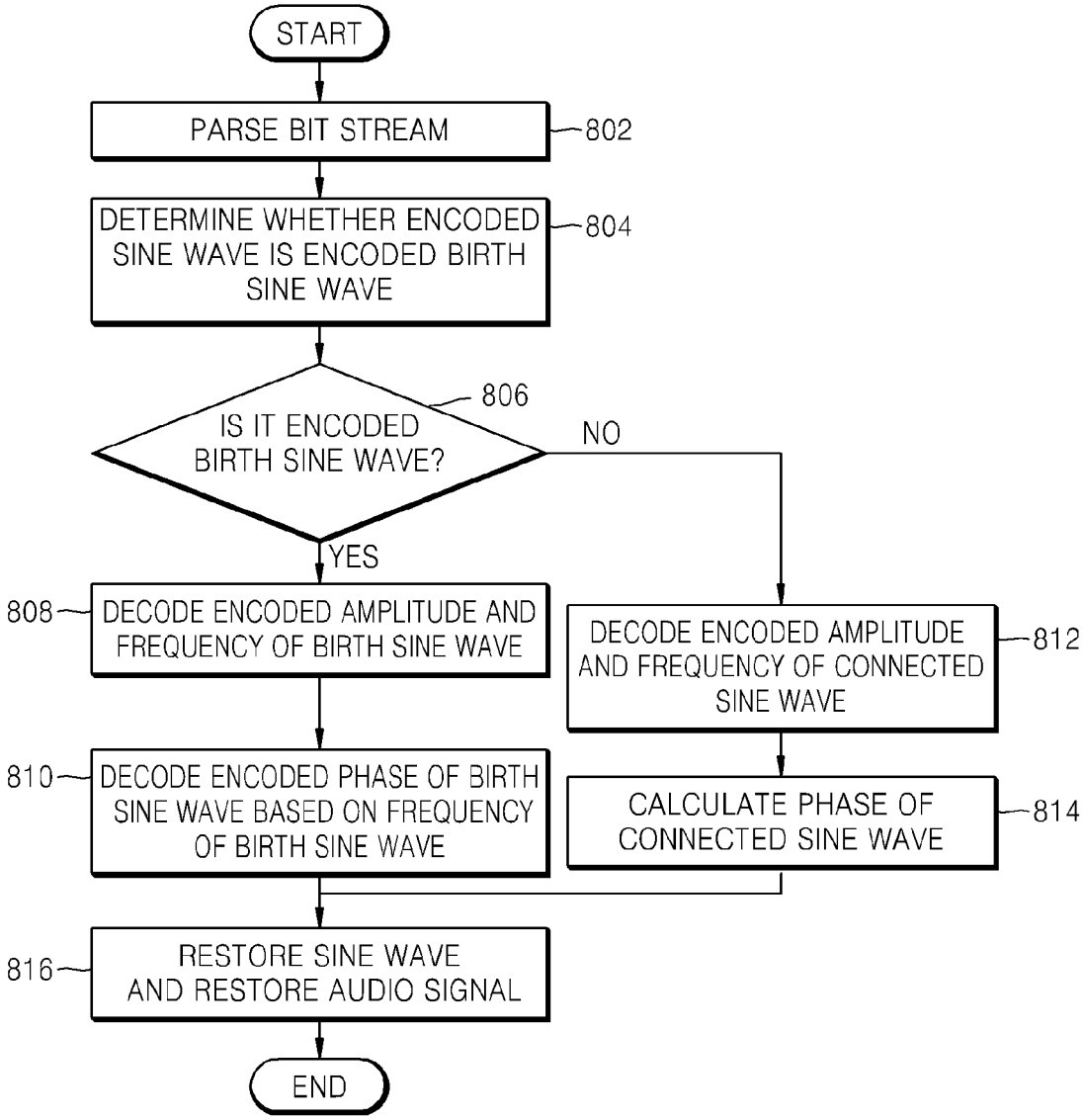
FIG. 8 is flowchart of a parametric audio decoding method according to an exemplary embodiment of the present invention.

FIG. 8 is flowchart of a parametric audio decoding method according to an exemplary embodiment of the present invention.

Referring to FIG. 8, in operation 802, an input bit stream is parsed to detect connection information, the amplitude of an encoded sine wave, the frequency of the encoded sine wave, or the phase of the encoded sine wave.

In operation 804, it is determined whether the encoded sine wave is an encoded birth sine wave. For example, whether the encoded sine wave is the encoded birth sine wave may be determined according to the connection information detected in operation 802.

If it is determined that the encoded sine wave is the encoded birth sine wave in operation 804, the encoded amplitude of the birth sine wave and the encoded frequency of the birth sine wave are decoded in operation 808.

In operation 810, the encoded phase of the birth sine wave is decoded on the basis of the decoded frequency of the birth sine wave.

For example, when the encoding operation is performed in the same way as in the exemplary embodiment of FIG. 2, if the frequency of the birth sine wave is higher than a predetermined frequency, the phase of the birth sine wave may be determined to be a random value between 0 and $2\pi$ radians.

If the encoding operation is performed in the same way as in the exemplary embodiments of FIGS. 3 and 4, the encoded phase of the birth sine wave may be decoded using the quantization step information included in the bit stream.

Also, if the encoding operation is performed in the same way as in the exemplary embodiments of FIGS. 3 and 4, the quantization step is determined using the frequency of the birth sine wave and the encoded phase of the birth sine wave may be decoded using the determined quantization step.

If it is determined that the encoded sine wave is not the encoded birth sine wave (i.e., is an encoded connected sine wave) in operation 804, the encoded amplitude of the connected sine wave and the encoded frequency of the connected sine wave are decoded in operation 812. Alternatively, the encoded amplitude of the connected sine wave and the encoded phase of the connected sine wave may be decoded.

In operation 814, the phase (or frequency) of the connected sine wave is calculated using the decoding results of operation 812.

In operation 816, the birth sine wave is restored using the amplitude, frequency and phase of the birth sine wave and an audio signal is restored using the restored birth sine wave.

Figure 9:
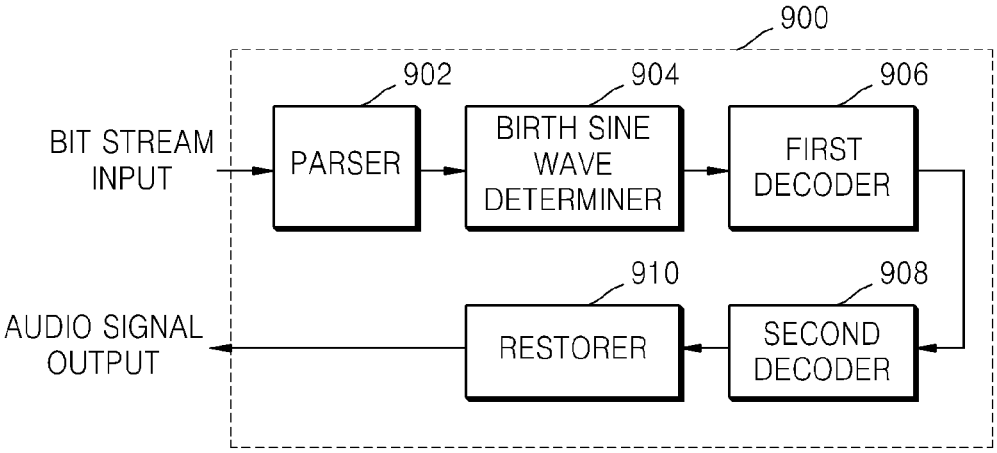
FIG. 9 is a block diagram of a parametric audio decoding apparatus according to an exemplary embodiment of the present invention.

FIG. 9 is a block diagram of a parametric audio decoding apparatus 900 according to an exemplary embodiment of the present invention.

Referring to FIG. 9, the parametric audio decoding apparatus 900 includes a parser 902, a birth sine wave determiner 904, a first decoder 906, a second decoder 908, and a restorer 910.

The parser 902 parses an input bit stream to detect connection information, the amplitude of an encoded sine wave, the frequency of the encoded sine wave, or the phase of the encoded sine wave.

The birth sine wave determiner 904 determines whether the encoded sine wave from the parser 902 is an encoded birth sine wave. For example, whether the encoded sine wave is the encoded birth sine wave may be determined based on the connection information from the parser 902.

If it is determined that the encoded sine wave is the encoded birth sine wave, the first decoder 906 decodes the encoded amplitude of the birth sine wave and the encoded frequency of the birth sine wave.

The second decoder 908 decodes the encoded phase of the birth sine wave on the basis of the decoded frequency of the birth sine wave. For example, if the frequency of the birth sine wave is higher than a predetermined frequency, the second decoder 908 may determine the phase of the start sine to be a random value between 0 and $2\pi$ radians. Also, the second decoder 908 may decode the phase of the encoded start sine using the quantization step information included in the bit stream. Also, the second decoder 908 may determine the quantization step using the frequency of the birth sine wave and may determine the encoded phase of the birth sine wave using the determined quantization step.

The restorer 910 restores the birth sine wave using the amplitude, frequency and phase of the birth sine wave and restores an audio signal using the restored birth sine wave.

The present invention can also be embodied as computer-readable codes on a computer-readable recording medium. The computer-readable recording medium is any data storage device that can store data that can be thereafter read by a computer system. Examples of the computer-readable recording medium include read-only memory (ROM), random-access memory (RAM), CD-ROMs, magnetic tapes, floppy disks, and optical data storage devices. The computer-readable recording medium can also be distributed over network-coupled computer systems so that the computer-readable code is stored and executed in a distributed fashion. The present invention can also be embodied as computer-readable codes transmitted via carrier waves (such as data transmission through the Internet)

According to the exemplary embodiments of the present invention described above, the number of bits allocated to the birth sine wave is reduced when the sine waves of the audio signal are connectively encoded. Therefore, it is possible to increase a compression rate while maintaining the sound quality of the audio signal.

While the present invention has been particularly shown and described with reference to exemplary embodiments thereof, it will be understood by one of ordinary skill in the art that various changes in form and details may be made therein without departing from the spirit and scope of the present invention as defined by the following claims.

What is claimed is:

1. A parametric audio encoding method comprising:

segmenting an audio signal into a plurality of segments;

extracting at least one sine wave from each the plurality of the segments;

connecting the extracted sine waves based on a frequency of each of the extracted sine waves;

determining whether each of the extracted sine waves is a birth sine wave based on a result of the connecting; and generating a bit stream by encoding the extracted sine waves based on a result of the determining, wherein the encoding comprises, if it is determined that an extracted sine wave is a birth sine wave, generating a bit stream by selectively encoding the phase of the birth sine wave based on a frequency of the birth sine wave, and wherein the selectively encoding the phase of the birth sine wave adjusts a number of bits allocated to encode the phase of the birth sine wave according to the frequency of the birth sine wave, and wherein the selectively encoding the phase of the birth sine wave allocates no bits to encode the phase of the birth sine wave if the frequency of the birth sine wave is higher than a threshold frequency.

2. The parametric audio encoding method of claim 1, wherein the selectively encoding the phase of the birth sine wave comprises:

determining a quantization step as a product of the frequency of the birth sine wave and a predetermined constant;

quantizing the phase of the birth sine wave according to the quantization step; and encoding the quantized phase of the birth sine wave.

3. The parametric audio encoding method of claim 1, wherein the selectively encoding the phase of the birth sine wave comprises:

converting the frequency of the birth sine wave into a psychoacoustic frequency;

determining a quantization step as the product of a psychoacoustic frequency and a predetermined constant;

quantizing the phase of the birth sine wave according to the quantization step; and encoding the quantized phase of the birth sine wave.

4. The parametric audio encoding method of claim 3, wherein the frequency of the sine wave is converted into the psychoacoustic frequency by one of an equivalent rectangular band function, a bark band scale function, and a critical band function.

5. The parametric audio encoding method of claim 1, wherein the bit stream comprises connection information indicating whether the sine wave is the birth sine wave, an encoded amplitude of the birth sine wave, and an encoded frequency of the birth sine wave.

6. The parametric audio encoding method of claim 5, wherein the bit stream further comprises quantization step information.

7. A parametric audio encoding apparatus comprising:

a segmenter which receives an audio signal and segments the audio signal into a plurality of segments;

a sine wave extractor which extracts at least one sine wave from each of the plurality of the segments;

a sine wave connector which connects the extracted sine waves based on a frequency of extracted sine waves;

a birth sine wave determiner which determines whether each of the extracted sine waves is a birth sine wave; and an encoder which generates a bit stream by encoding the extracted sine waves based a result of the determination by the birth sine wave determiner, and outputs the bit stream, wherein if it is determined that an extracted sine wave is a birth sine wave, the encoder selectively encodes the phase of the birth sine wave based on a frequency of the birth sine wave, and adjusts the number of bits allocated to encode the phase of the birth sine wave according to the frequency of the birth sine wave, wherein the encoder allocates no bits to encode the phase of the birth sine wave if the frequency of the birth sine wave is higher than a threshold frequency, and wherein at least one of the segmenter, the sine wave extractor, the sine wave connector, the birth sine wave determiner, and the encoder is implemented as a hardware component using a computer.

8. The parametric audio encoding apparatus of claim 7, wherein the encoder comprises:

a quantization step determiner which determines a quantization step as a product of the frequency of the birth sine wave and a predetermined constant;

a quantizer which quantizes the phase of the birth sine wave according to the quantization step; and a bit stream generator which generates a bit stream by encoding the quantized phase of the birth sine wave.

9. The parametric audio encoding apparatus of claim 7, wherein the encoder comprises:

a frequency converter which converts the frequency of the birth sine wave into a psychoacoustic frequency;

a quantization step determiner which determines a quantization step as a product of the psychoacoustic frequency and a predetermined constant;

a quantizer which quantizes the phase of the birth sine wave according to the quantization step; and a bit stream generator which generates a bit stream by encoding the quantized phase of the birth sine wave.

10. A parametric audio decoding method comprising:

parsing a bit stream;

determining whether an encoded sine wave is an encoded birth sine wave based on connection information;

if it is determined that the encoded sine wave is the encoded birth sine wave, decoding an encoded amplitude of the birth sine wave and an encoded frequency of the birth sine wave;

decoding an encoded phase of the birth sine wave based on the decoded frequency of the birth sine wave if the decoded frequency is lower than a threshold frequency;

determining the decoded phase of the birth sine wave to be a random value between 0 and $2\pi$ radians, if the frequency of the birth sine wave is higher than the threshold frequency; and restoring the birth sine wave using the decoded amplitude, the decoded frequency and the decoded phase of the birth sine wave, and restoring an audio signal using the restored birth sine wave.

11. The parametric audio decoding method of claim 10, wherein the decoding the encoded phase of the birth sine wave decodes the encoded phase of the birth sine wave using quantization step information included in the bit stream.

12. The parametric audio decoding method of claim 10, wherein the decoding the encoded phase of the birth sine wave comprises:

determining a quantization step using the frequency of the birth sine wave; and decoding the encoded phase of the birth sine wave using the quantization step.

13. The parametric audio decoding method of claim 10, wherein the bit stream comprises connection information indicating whether the encoded sine wave is the encoded birth sine wave, and quantization step information.

14. A parametric audio decoding apparatus comprising:

a parser which receives a bit stream and parses the bit stream ;

a birth sine wave determiner which determines, based on connection information, whether an encoded sine wave output from the parser is an encoded birth sine wave;

a first decoder which decodes an encoded amplitude of the birth sine wave and an encoded frequency of the birth sine wave if the birth sine wave determiner determines that the encoded sine wave is the encoded birth sine wave;

a second decoder which decodes an encoded phase of the birth sine wave based on the decoded frequency of the birth sine wave if the decoded frequency is lower than a threshold frequency, and determines the decoded phase of the birth sine wave to be a random value between 0 and $2\pi$ radians, if the frequency of the birth sine wave is higher than the threshold frequency; and a restorer which restores the birth sine wave using the decoded amplitude, the decoded frequency and the decoded phase of the birth sine wave, and restores an audio signal using the restored birth sine wave, and outputs the audio signal, wherein at least one of the segmenter, the sine wave extractor, the sine wave connector, the birth sine wave determiner, and the encoder is implemented as a hardware component using a computer.

15. The parametric audio decoding apparatus of claim 14, wherein the second decoder decodes the encoded phase of the birth sine wave using quantization step information included in the bit stream.

16. The parametric audio decoding apparatus of claim 14, wherein the second decoder determines a quantization step using the frequency of the birth sine wave, and decodes the encoded phase of the birth sine wave using the quantization step.

17. A non-transitory computer-readable recording medium storing a program for performing a parametric audio encoding method comprising:

segmenting an audio signal into a plurality of segments;

extracting at least one sine wave from each of the plurality of the segments;

connecting the extracted sine waves based on a frequency of each of the extracted sine waves;

determining whether each of the extracted sine waves is a birth sine wave based on a result of the connecting; and generating a bit stream by encoding the extracted sine waves based on a result of the determining, wherein the encoding comprises, if it is determined that an extracted sine wave is a birth sine wave, generating a bit stream by selectively encoding the phase of the birth sine wave based on a frequency of the birth sine wave, wherein the selectively encoding the phase of the birth sine wave adjusts a number of bits allocated to encode the phase of the birth sine wave according to the frequency of the birth sine wave, wherein the selectively encoding the phase of the birth sine wave allocates no bits to encode the phase of the birth sine wave if the frequency of the birth sine wave is higher than a threshold frequency.

18. A non-transitory computer-readable recording medium storing a program for performing a parametric audio decoding method comprising:

parsing a bit stream;

determining whether an encoded sine wave is an encoded birth sine wave;

if it is determined that the encoded sine wave is the encoded birth sine wave, decoding an encoded amplitude of the birth sine wave and an encoded frequency of the birth sine wave;

decoding an encoded phase of the birth sine wave based on the decoded frequency of the birth sine wave if the decoded frequency is lower than a threshold frequency;

determining the decoded phase of the birth sine wave to be a random value between 0 and $2\pi$ radians, if the frequency of the birth sine wave is higher than the threshold frequency; and restoring the birth sine wave using the decoded amplitude, the decoded frequency and the decoded phase of the birth sine wave, and restoring an audio signal using the restored birth sine wave.

* * * * *